US008721476B2

(12) United States Patent
Mayers

(10) Patent No.: US 8,721,476 B2
(45) Date of Patent: May 13, 2014

(54) INTERACTIVE BASKETBALL TRAINER

(76) Inventor: Steven Wayne Mayers, Surfside, FL (US)

( * ) Notice: Subject to any disclaimer, the term of this patent is extended or adjusted under 35 U.S.C. 154(b) by 69 days.

(21) Appl. No.: 13/385,093

(22) Filed: Feb. 1, 2012

(65) Prior Publication Data

US 2012/0208660 A1 Aug. 16, 2012

Related U.S. Application Data

(60) Provisional application No. 61/462,583, filed on Feb. 5, 2011.

(51) Int. Cl.
*A63B 69/06* (2006.01)

(52) U.S. Cl.
USPC ..... 473/447

(58) Field of Classification Search
USPC ..... 473/445–450; 446/325, 326, 360, 274, 446/354; 40/411, 412, 414, 419
See application file for complete search history.

(56) References Cited

U.S. PATENT DOCUMENTS

| | | | | | |
|---|---|---|---|---|---|
| 952,862 | A * | 3/1910 | Armstrong | 482/85 |
| 1,604,206 | A * | 10/1926 | Tilton | 446/287 |
| 1,643,916 | A * | 9/1927 | Becker | 446/273 |
| 2,671,984 | A * | 3/1954 | Morin | 446/354 |
| 3,100,364 | A * | 8/1963 | May | 446/279 |
| 3,442,045 | A * | 5/1969 | Green | 446/297 |
| 3,552,749 | A | 1/1971 | Piggotte | |
| 3,675,921 | A | 7/1972 | Meyers | |
| 4,168,062 | A * | 9/1979 | McCarthy et al. | 473/446 |
| 4,989,862 | A | 2/1991 | Curtis | |
| 5,527,185 | A * | 6/1996 | Davis | 473/438 |
| 5,800,291 | A * | 9/1998 | Grover | 473/447 |
| 5,816,951 | A * | 10/1998 | Hudock | 473/447 |
| D539,373 | S * | 3/2007 | Cook | D21/781 |
| 7,258,591 | B2 * | 8/2007 | Xu et al. | 446/273 |
| 7,658,689 | B2 * | 2/2010 | Crook, II | 473/447 |
| 8,277,340 | B1 * | 10/2012 | Devine | 473/447 |
| 2005/0075198 | A1 * | 4/2005 | Rhyne et al. | 473/447 |
| 2005/0192126 | A1 * | 9/2005 | Remaklus | 473/447 |
| 2007/0010354 | A1 * | 1/2007 | White | 473/447 |
| 2007/0225089 | A1 * | 9/2007 | Jones | 473/447 |
| 2008/0261728 | A1 * | 10/2008 | Bridge et al. | 473/447 |
| 2009/0149281 | A1 | 6/2009 | Johnson | |
| 2009/0156333 | A1 * | 6/2009 | Bridge et al. | 473/447 |

* cited by examiner

*Primary Examiner* — Mark Graham
(74) *Attorney, Agent, or Firm* — Robert M. Schwartz

(57) ABSTRACT

This invention presents a basketball training device which resembles a mannequin that defends against basketball players with a series of blocking motions. When a proximity sensor detects an approaching player, a control unit initiates waving of forearms, raising/lowering of upper arms, chopping motion of arms and torso raising and lowering. An audio circuit plays music or realistic background noises. When convex bottom of primary base is placed on a floor, weight of ballast and rechargeable batteries allows the device to return to an upright position when tipped. A gyroscopic unit within a control unit can activate when the device tips to ensure return of the device to an upright position. Alternatively, the unit can be placed with the secondary base, which features castors that allow the unit to roll when stuck and facilitates placement on a basketball court.

3 Claims, 2 Drawing Sheets

INTERACTIVE BASKETBALL TRAINER

CROSS-REFERENCE TO RELATED APPLICATIONS

This application is preceded by provisional patent 61/462,583 entitled "Interactive Basketball Training Device" filed on Feb. 5, 2011 which embodies the present design.

STATEMENT REGARDING FEDERALLY SPONSORED RESEARCH OR DEVELOPMENT

Not Applicable

REFERENCE TO SEQUENCE LISTING, A TABLE OR A COMPUTER LISTING COMPACT DISK APPENDIX

Not Applicable

BACKGROUND OF THE INVENTION

This invention pertains to devices that simulate game conditions of competitive sports for honing of player skills. Specifically, this device pertains to obstacles created by opposing players during a basketball game. Past inventions have demonstrated a variety of training devices for amateur and professional athletes that simulate an opposing player. The football blocking sled is a commonly recognized device of this type. These types of devices are typically: (a) non-interactive, stationary units that do not simulate movement of an opposing player; and (b) do not generate audio affects to simulate additional distractions encountered by players.

Piggotte U.S. Pat. No. 3,552,749 discloses a basketball practicing device with rotatable spokes driven by an electric motor drive system. It does not present a realistic human form, articulated arms or torso, proximity-actuated functions, or a sound-effects system.

Meyers U.S. Pat. No. 3,675,921 discloses a motorized simulated player with a pair of upwardly-projecting arms. The device has powered arm motion and simulated jumping action with remote control. However, it does not feature tipping-recovery system, sound effects or alternate bases. Moreover, the jumping action uses a rod that pushes against the floor which can potentially destabilize the device.

Curtis U.S. Pat. No. 4,989,862 discloses a basketball device, which features a telescoping system involving a moveable mechanism of springs and coils to adjust torso height and rotate arms. However, all positions must be manually set and cannot be actuated automatically.

Johnson U.S.20090149281 presents a figurine with four arms which can be deflated when not in use, but this device is stationary and does not present automated arm/torso movement.

BRIEF SUMMARY OF THE INVENTION

The invention disclosed herein provides a device that can provide a more realistic and interactive level of action to basketball training. Said device resembles an opposing team member attempting to block a player using electrically waving arms and variable torso height. Arm and torso motion can be adjusted via electronic controls. The unit can be activated automatically when a player approaches, and can be programmed or operated via remote control. Self-contained power source allows use without obstruction from electrical cords. The unit can also be configured with a rocking primary base or a wheeled secondary base. These options prevent the device from being knocked over if struck, by allowing the unit to either return to an upright position when tipped or roll out of the way. Yet another unique feature is the inclusion of a sound effects system with various volume levels that can play music or realistic background noises of a basketball game that strengthens player concentration. The net effect is to provide a training simulator that sharpens both the physical and psychological prowess of basketball players. This unique combination of features presents an invention that is novel and a substantial improvement over prior art.

BRIEF DESCRIPTIONS OF THE SEVERAL VIEWS OF THE DRAWING

DETAILED DESCRIPTION OF THE INVENTION

Figure 1:
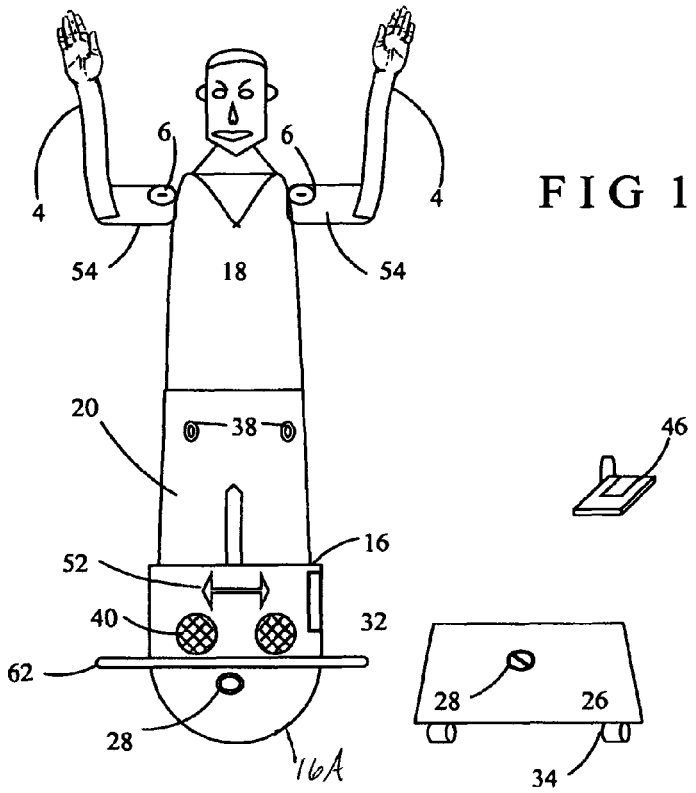
FIG. 1 depicts a frontal view of the invention.
Figure 2:
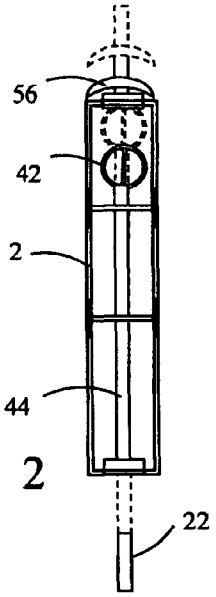
FIG. 2 depicts an internal side view of the invention's torso section.
Figure 3:
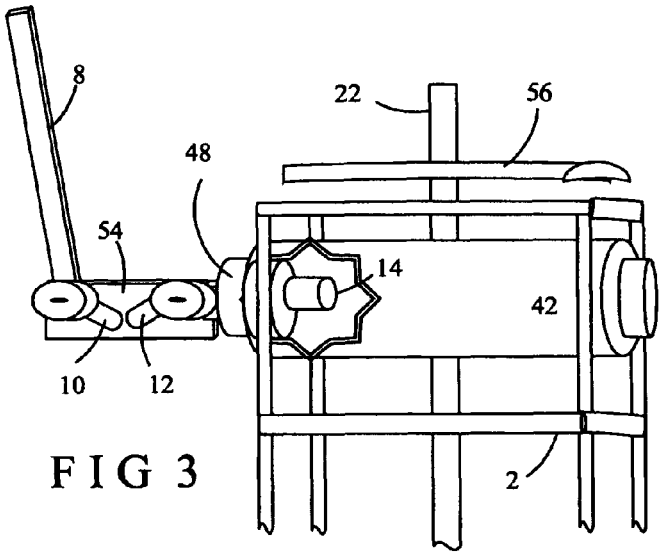
FIG. 3 depicts a rear ¾ internal view of the invention's torso section.
Figure 4:
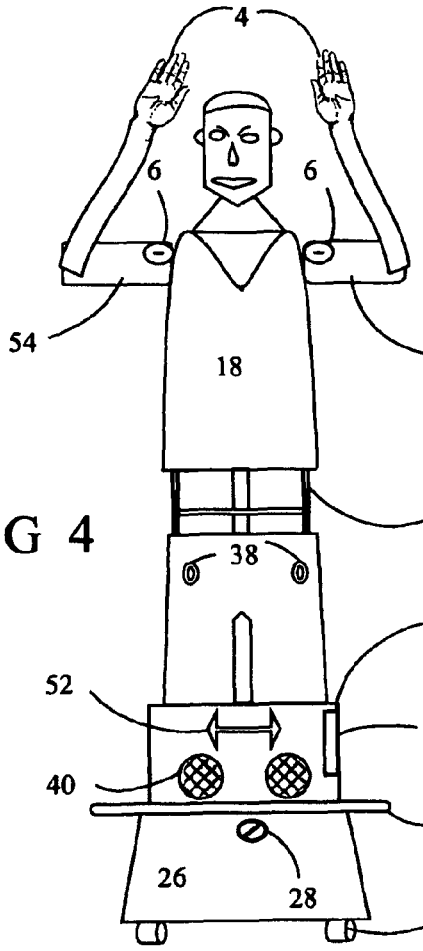
FIG. 4 depicts a frontal view of the invention.
Figure 5:
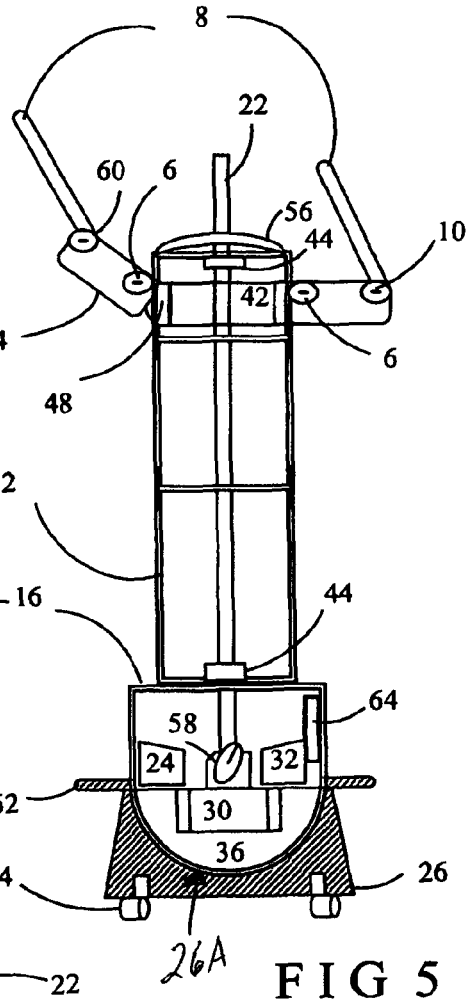
FIG. 5 depicts a frontal internal view of the invention.
Figure 6:
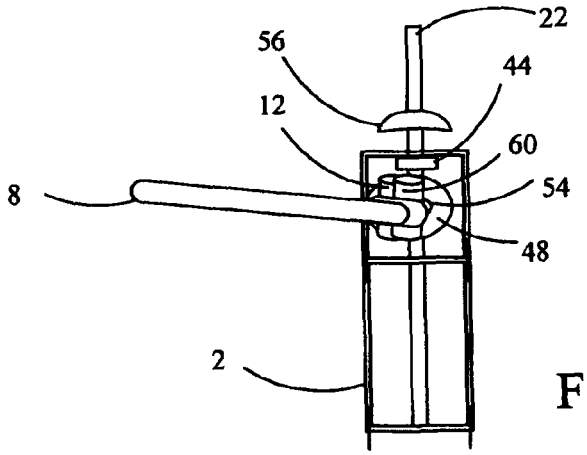
FIG. 6 depicts an internal side view of the invention's torso section with an arm in "chopping" position.

This invention consists of the following components as depicted in FIGS. 1 through 6. Frame 2 embodies a series of girder segments fabricated from a rigid material, which are affixed together to form a structure having open plane faces and a vertical dimension significantly greater than the horizontal dimension. The posterior end of frame 2 is rigidly attached to the anterior face of primary base 16. Shaft 22 slides vertically within shaft supports 44 at the anterior and posterior faces of frame 2. Posterior end of shaft is connected to torso servo 58. Shoulder tube 42 is rigidly affixed to shaft 22 so that both components are in perpendicular orientation resulting in a crucifix configuration. Shoulder flange 56 is mounted near the anterior end of shaft 22. Each upper arm 54 is attached to shoulder tube 42 via rotating joint 48. A rotation servo 14 is mounted within each terminal end of shoulder tube 42 and has its output drive connected to upper arm 54 via rotation joint 48. Upper arm 54 is connected to rotation joint 48 via pivoting shoulder joint 6. Shoulder servo 12 is mounted onto upper arm 54, with a mechanical drive connected to shoulder joint 6. Elbow servo 10 is mounted onto upper arm 54, with a mechanical drive connected to elbow joint 60. Forearm 8 is attached to upper arm 54 via pivoting elbow joint 60. Each forearm 8 is covered with arm cover 4, consisting of a cosmetic plastic or rubber sleeve molded to resemble the human forearm and hand. Each of the aforementioned arm and shoulder components is fabricated from a rigid, rust-resistant material such as lightweight plastic, wood, metal or rubber. Frame 2 is covered by a torso shell 18 and leg shell 20 which are configured to represent a standing human figure in multidimensional form. Said shells are fabricated of a rigid material such as plastic or rubber. The shoulders of torso shell 18 detachably mounted onto shoulder flange 56 while leg shell 20 is detachably mounted onto the lower section of frame 2. Audio system 24 containing at least two separate recording and playback circuits is mounted within primary base 16. Said circuits can utilize a variety of digital storage formats (e.g. hard disk, flash memory, CD, MP3). A plurality of speakers 40 are mounted within primary base 16. Control unit 32 is mounted within primary base 16 and has a control panel 64 positioned within an opening in said primary base.

Control unit 32 can consist of a simple set manual switches or a digital timer/microprocessor control system, and is electrically connected to all servos and audio system 24. It can also contain a gyroscopic unit which will assist the device in regaining an upright position when tipped. Remote control 46 can interface with control unit 32 wirelessly or via removable cable plugged into control panel 64. It may also include downloadable control applications. Proximity sensor 38 is mounted within leg shell 20 in the preferred embodiment and connected to the electrical circuit of control unit 32. Secondary base 26 consists of a shell molded of a rigid material featuring a concave anterior cavity 26A which exactly corresponds to the convex posterior face 16A of primary base 16. The primary base 16 consists of a hollow shell molded in a rigid material which is conically shaped. The posterior end of said secondary base 26 features a flat posterior face onto which a plurality of castors 34 are mounted. Ballast 36 is mounted within the posterior end of primary base 16 in such fashion as to allow the primary base 16 and frame 2 unit to balance in an upright position. Handles 52 are mounted onto the external surface of primary base 16. Skirt 62 extending around the circumference of primary base 16 acts as a stabilizing member to prevent over-tipping of the device.

This invention presents a basketball training device which resembles a mannequin that defends against basketball players with a series blocking of motions. Control unit 32 allows unit to be activated in a simple on/off fashion or with a variable series of programmable motions. When proximity sensor 38 detects an approaching player, control unit 32 signals the following operational sequence. Activation of elbow servo(s) 10 acts upon elbow joint 60 resulting in waving of forearm 8. Activation of shoulder servo(s) 24 acts upon shoulder joint 6 resulting in raising/lowering of upper arm 54. Activation of rotation servo(s) 14 acts upon rotation joint 48 resulting in a chopping motion of arms. Activation of torso servo 58 produces vertical movement of shaft 22, resulting in raising and lowering of the torso shell and arm/shoulder unit via shaft 22. Activation of audio circuitry plays music or realistic background noises. When convex bottom of primary base 16 is placed on a floor; weight of ballast 36 and rechargeable batteries 30 allows the device to return to an upright position when tipped. A gyroscopic unit within control unit 32 can activate when the device tips beyond a specific angle and ensure return of the device to an upright position. Alternatively, primary base 16 can be placed within concave cavity of secondary base 26 and secured by engaging latch 28 with latch socket 50. Castors 34 mounted on the obverse face of secondary base 26 allow the unit to roll when struck and facilitates placement on a basketball court.

This device is a basketball training device which resembles a mannequin that defends against basketball players with a series blocking of motions. Control unit 32 allows unit to be activated in a simple on/off fashion or with a variable series of programmable motions. When proximity sensor 38 detects an approaching player, control unit 32 signals the following operational sequence.

- Activation of elbow servo(s) 10 acts upon elbow joint 60 resulting in waving of forearm 8;
- Activation of shoulder servo(s) 12 acts upon shoulder joint 6 resulting in raising/lowering of upper arm 54.
- Activation of rotation servo(s) 14 acts upon rotation joint 48 resulting in a chopping motion of arms.
- Activation of torso servo 58 produces vertical movement of shaft 22, resulting in raising and lowering of the torso shell and arm/shoulder unit via shaft 22.
- Activation of audio circuitry which plays music or realistic background noises.

These motions can be accomplished with both arms in unison or independently, with speed and timing of each joint being adjustable. Arms can also be locked in a desired position (i.e. upward or outward). Adjustable proximity sensor 38 allows user to vary the approach distance required for activation. A separate proximity sensor 38 allows for the independent activation of a portion of the audio circuitry, whereby tipping of the device initiates playback of realistic basketball background noises (e.g. foul whistle, "trash talk", booing). Another portion of the audio circuitry can play music or other sounds as desired by user or via sensor activation. When convex bottom of primary base 16 is placed on a floor; weight of ballast 36 and rechargeable batteries 30 allows the device to return to an upright position when tipped. A gyroscopic unit within control unit 32 can activate when the device tips beyond a specific angle and ensure return of the device to an upright position. Alternatively, primary base 16 can be placed within concave cavity of secondary base 26 and secured by engaging latch 28 with latch socket 50. Castors 34 mounted on the obverse face of secondary base 26 allow the unit to roll when stuck and facilitates placement on a basketball court. Control unit 32 also activates audio system 24 which can play realistic background noises of a basketball game via speakers 40. A plurality of handles 52 allow easy carrying and placement of the device.

Nothing in the language of this application should be construed as creating limitation of the scope of the invention. For example, the servos used to actuate joints can be comprised of electric motors and gearboxes, solenoids, pneumatic actuators, hydraulic actuators or a combination thereof. Structural materials employed can be metal, plastic, carbon fiber or wood, while cosmetic outer coverings can comprise vinyl, rubber or plastic. Therefore, the description and claims presented herein are intended to present the preferred embodiment of the device.

I claim:

1. An interactive sports training device which simulates an opposing player which exhibits a range of aggressive and defensive motions and sound effects comprising;

a) a frame consisting of a plurality of girder segments fabricated from a rigid material and affixed together to form a structure including open plane faces and an overall vertical dimension significantly greater than its horizontal dimension;

b) a primary base consisting of a hollow shell molded of a rigid material, which is conically-shaped and includes an anterior face which is flat and a posterior end which tapers to form a compound face, with said primary base having said anterior face rigidly attached onto a posterior face of said frame; and c) a secondary base including a shell molded of a rigid material which features a concave anterior cavity which allows a corresponding convex posterior face of said primary base to be removably nested within said concave anterior cavity, with a posterior end of said secondary base featuring a flat face onto which a plurality of castors are mounted.

2. The interactive sports training device in claim 1 including:

a) a rigid actuator shaft which extends vertically from within said primary base and upwardly through support collars mounted onto said posterior face and an anterior face of said frame, with a flange member mounted near an anterior end of said actuator shaft so that said flange rests atop said frame's said anterior face;

b) a rigid shoulder tube which is permanently affixed onto an upper section of said actuator shaft, said rigid shoulder tube and said actuator shaft are in perpendicular orientation resulting in a crucifix configuration, with said rigid shoulder tube having a horizontal width of about that of the upper portion of said frame, said rigid shoulder tube having a first end and a second end, said first end including a first servo actuated rotating joint mounted thereon, and said second end including a second servo actuated rotating joint mounted thereon;

c) a first upper arm unit and a second upper arm unit, said first upper arm unit is connected to said first servo actuated rotating joint by a first pivot joint at a first proximal end and said second upper arm unit connected to said second servo actuated rotating joint by a second pivot joint at a second proximal end, an articulating third servo connected to said first upper arm unit' and an articulating fourth servo connected to said second upper arm unit, a first lower arm unit connected to said articulating third servo and, a second arm unit connected to said articulating fourth servo wherein said first upper arm unit, said second upper arm unit, said first lower arm unit and said second lower arm unit are all comprised of a rigid material.

3. The interactive sports training device as claimed in claim 2 comprising:

a) an outer covering molded from a pliable material, comprising a leg section which is attached onto a lower portion of said frame and an upper torso head section which slides over said upper portion of said frame until it rests atop said flange;

b) said primary base contains a latch for securing said primary base into said secondary base, a torso servo which engages a posterior end of said actuator shaft, a plurality of speakers, a plurality of externally mounted handles, ballast mounted within said primary base convex lower posterior end; and a skirt projecting around the exterior of said primary base perimeter; and c) an electronic sound system and a controller for said interactive sports training device mounted within said primary base comprising a remote control receiver, a gyroscopic positioning unit, a plurality of shoulder flange proximity sensors, a control panel, a control unit, a sound effects system and rechargeable batteries, with said electronic sound system and said controller for said interactive sports training device being electrically interconnected with said remote control receiver, said gyroscopic positioning unit, said plurality of shoulder flange proximity sensors, said control panel, said control unit, said sound effects system and said rechargeable batteries, and in communication with said first servo actuated rotating joint , said second servo actuated rotating joint, said articulating third servo, said articulating fourth servo, and said torso servo whereby a user-programmable sequence of motion and sound effects can be activated manually with a remote control transmitter and/or via physical proximity of an approaching human player.

* * * * *